US006206208B1

(12) United States Patent
Dennig

(10) Patent No.: US 6,206,208 B1
(45) Date of Patent: Mar. 27, 2001

(54) JEWELRY STAND

(76) Inventor: Linda M. Dennig, c/o Lisa Darden 2020 Cox Neck Rd., Chester, MD (US) 21619

( * ) Notice: Subject to any disclaimer, the term of this patent is extended or adjusted under 35 U.S.C. 154(b) by 0 days.

(21) Appl. No.: 09/405,703

(22) Filed: Sep. 24, 1999

(51) Int. Cl.[7] ..... A47F 7/02
(52) U.S. Cl. ..... 211/85.2
(58) Field of Search ..... 211/85.2, 163, 211/13.1, 10, 58, 70, 78, 95, 115

(56) References Cited

U.S. PATENT DOCUMENTS 4,850,658 * 7/1989 Sandor ..... 211/85.2
5,054,624 * 10/1991 Camp ..... 211/85.2
5,979,678 * 11/1999 Kelly ..... 211/85.2

* cited by examiner

*Primary Examiner*—Alvin Chin-Shue
*Assistant Examiner*—Sarah Purol

(57) ABSTRACT

A jewelry holder is provided including a base and a post rotatably coupled thereto. Also included is a plurality of planar plates each with an inboard edge coupled to the post for supporting jewelry thereon.

9 Claims, 2 Drawing Sheets

FIG 1
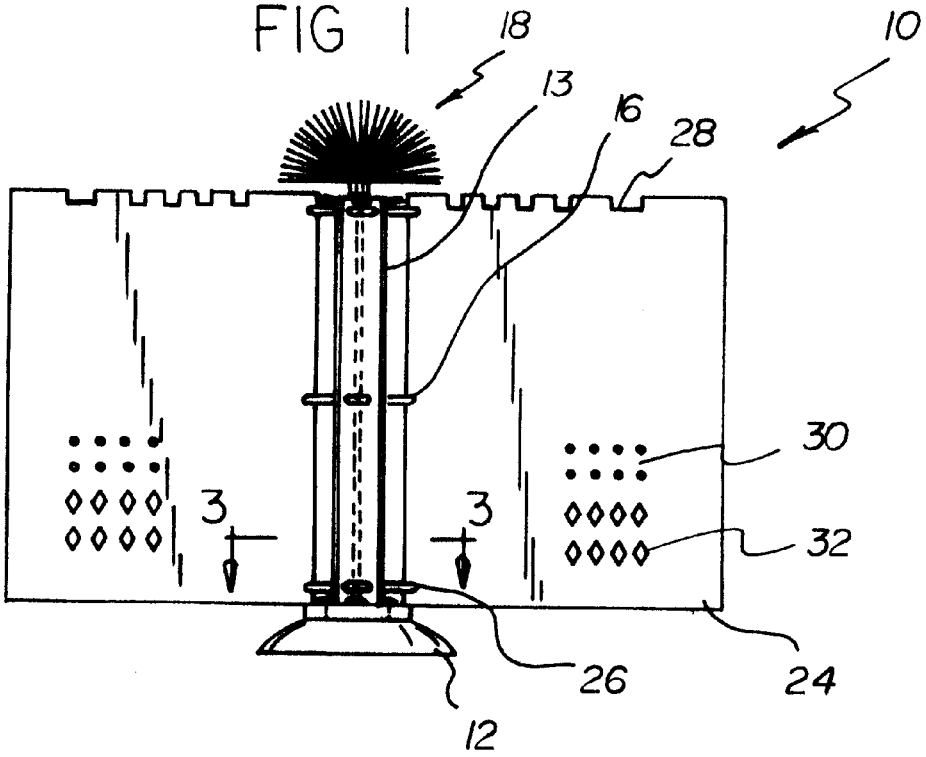
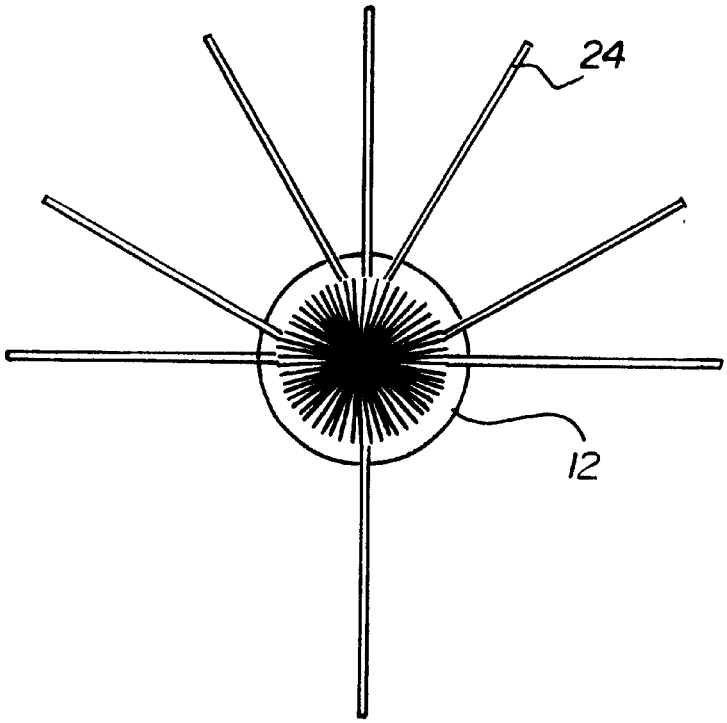
FIG 2

JEWELRY STAND

BACKGROUND OF THE INVENTION

1. Field of the Invention

The present invention relates to jewelry boxes and more particularly pertains to a new jewelry stand for organizing various types of jewelry.

2. Description of the Prior Art

The use of jewelry boxes is known in the prior art. More specifically, jewelry boxes heretofore devised and utilized are known to consist basically of familiar, expected and obvious structural configurations, notwithstanding the myriad of designs encompassed by the crowded prior art which heave been developed for the fulfillment of countless objectives and requirements.

Known prior art jewelry boxes include U.S. Pat. No. 5,052,563; U.S. Pat. No. 5,370,453; U.S. Pat. No. Des. 344,647; U.S. Pat. No. 4,720,012; U.S. Pat. No. 4,390,099; and U.S. Pat. No. Des. 335,593.

In these respects, the jewelry stand according to the present invention substantially departs from the conventional concepts and designs of the prior art, and in so doing provides an apparatus primarily developed for the purpose of organizing various types of jewelry.

SUMMARY OF THE INVENTION

In view of the foregoing disadvantages inherent in the known types of jewelry boxes now present in the prior art, the present invention provides a new jewelry stand construction wherein the same can be utilized for organizing various types of jewelry.

The general purpose of the present invention, which will be described subsequently in greater detail, is to provide a new jewelry stand apparatus and method which has many of the advantages of the jewelry boxes mentioned heretofore and many novel features that result in a new jewelry stand which is not anticipated, rendered obvious, suggested, or even implied by any of the prior art jewelry boxes, either alone or in any combination thereof.

To attain this, the present invention generally includes a weighted base having a flat circular bottom face with a first diameter and a flat circular top face with a second diameter less than the first diameter; a vertically oriented post rotatably coupled to the top face of the base about a central vertical axis, the post having four elongated side faces extending between a top and bottom end thereof, each side face having three spaced O-ring binder rings each having an inboard end hingably coupled to the post and an outboard end with a pair of free ends with a first orientation in engagement with each other and a second orientation separated from each other; a decorative assembly including a threaded shaft extending upwardly from the post and a hemispherical decoration screwably coupled to the post; and a plurality of planar rectangular plates each formed from a rigid material, each plate having a periphery including a short top edge, a short bottom edge and a pair of elongated side edges, an inboard one of the side edges of each plate having three vertically aligned apertures formed therein for releasably coupling with the binder rings of one of the side faces of the post, the top edge of each plate having a plurality of rectangular cut outs formed therein and having varying widths for supporting necklaces, each plate further having a matrix of circular bores formed therein adjacent to the bottom edge thereof for receiving posts of pierce earrings and a matrix of diamond-shaped bores formed in each plate adjacent to the bottom edge thereof beneath the matrix of circular bores for receiving clips of clip earrings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new jewelry stand apparatus and method which has many of the advantages of the jewelry boxes mentioned heretofore and many novel features that result in a new jewelry stand which is not anticipated, rendered obvious, suggested, or even implied by any of the prior art jewelry boxes, either alone or in any combination thereof.

It is another object of the present invention to provide a new jewelry stand which may be easily and efficiently manufactured and marketed.

It is a further object of the present invention to provide a new jewelry stand which is of a durable and reliable construction.

An even further object of the present invention is to provide a new jewelry stand which is susceptible of a low cost of manufacture with regard to both materials and labor, and which accordingly is then susceptible of low prices of sale to the consuming public, thereby making such jewelry stand economically available to the buying public.

Still yet another object of the present invention is to provide a new jewelry stand which provides in the apparatuses and methods of the prior art some of the advantages thereof, while simultaneously overcoming some of the disadvantages normally associated therewith.

Still another object of the present invention is to provide a new jewelry stand for organizing various types of jewelry.

Even still another object of the present invention is to provide a new jewelry stand that includes a base and a post rotatably coupled thereto. Also included is a plurality of planar plates each with an inboard edge coupled to the post for supporting jewelry thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of a new jewelry stand according to the present invention.

FIG. 2 is a top view of the present invention.

DESCRIPTION OF THE PREFERRED EMBODIMENT

Figure 3:
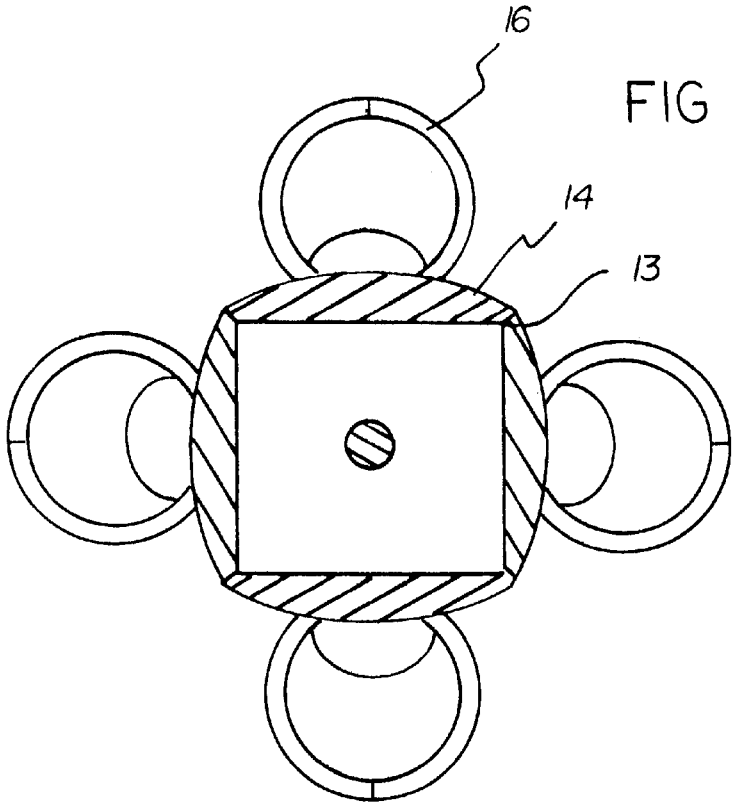
FIG. 3 is a top cross-sectional view of the post of the present invention taken along line 3—3 shown in FIG. 1.

With reference now to the drawings, and in particular to FIGS. 1 through 4 thereof, a new jewelry stand embodying the principles and concepts of the present invention and generally designated by the reference numeral 10 will be described.

The present invention, designated as numeral 10, includes a weighted base 12 having a flat circular bottom face with a first diameter. Such weighted base further has a flat circular top face with a second diameter less than the first diameter.

Also included is a vertically oriented post 13 rotatably coupled to the top face of the base about a central vertical axis by way of a plurality of ball bearings. The post has four elongated generally arcuate side faces 14 extending between a top and bottom end thereof. As shown in FIG. 3, each side face has three vertically spaced O-ring binder rings 16 mounted thereon. Each binder ring has a pair of inboard ends hingably coupled to the post about a vertical axis which is fixed with respect to the post. Further, each binder ring is equipped with a pair of free outboard ends. In use, such free ends have a first orientation in engagement with each other and a second orientation separated from each other. In the preferred embodiment, a spring is associated with each binder ring to maintain the free outboard ends in either the first or second orientation in the absence of an outside force. As such, the binder rings of the present invention are similar to those employed in the art of notebooks.

Figure 4:
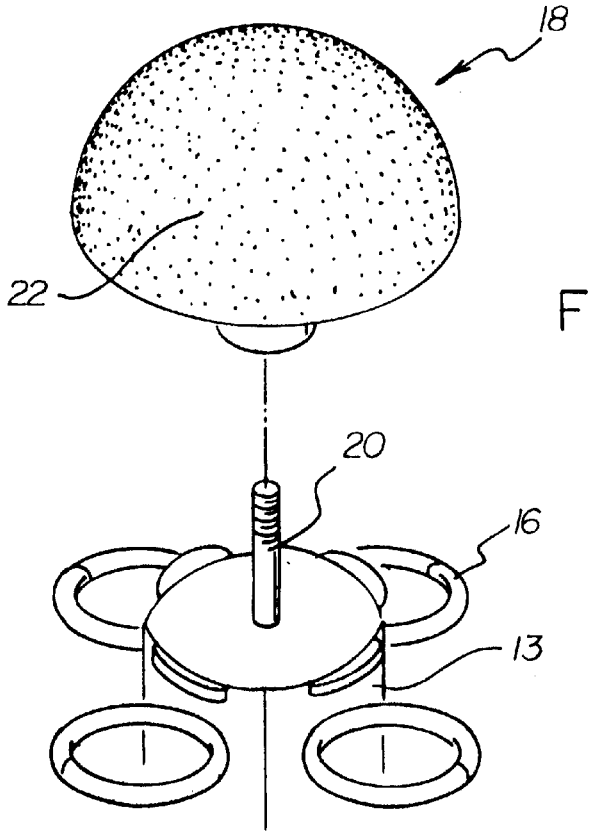
FIG. 4 is an exploded perspective view of the decoration assembly of the present invention.

FIG. 4 shows a decorative assembly 18 including a threaded shaft 20 extending upwardly from the post. A hemispherical decoration 22 is screwably coupled to the post. It should be noted that the decoration may take any form including a bundle of decorative strands, as shown in FIGS. 1 & 2. Such strands preferably have colors which match the base.

With reference now to FIGS. 1 & 2, a plurality of planar rectangular plates 24 are shown to be formed from a rigid material. Such material may be transparent or any other desired color. Each plate has a periphery including a short top edge, a short bottom edge and a pair of elongated side edges. An inboard one of the side edges of each plate has three vertically aligned apertures 26 formed therein for releasably coupling with the binder rings of one of the side faces of the post.

For holding necklaces, the top edge of each plate has a plurality of rectangular cut outs 28 formed therein. Such cut outs preferably have varying widths. Each plate further has a matrix of circular bores 30 formed therein adjacent to the bottom edge thereof. Such circular bores are adapted for releasably receiving posts of pierce earrings. Formed in each plate between the bottom edge thereof and the matrix of circular bores is a matrix of diamond-shaped bores 32 for releasably receiving clips of clip earrings. Additional bores may also be included for lapel pins and other types of jewelry.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jewelry holder comprising, in combination:

a weighted base having a flat circular bottom face with a first diameter and a flat circular top face with a second diameter less than the first diameter;

a vertically oriented post rotatably coupled to the top face of the base about a central vertical axis, the post having four elongated side faces extending between a top and bottom end thereof, each side face having three spaced O-ring binder rings each having an inboard end hingably coupled to the post and an outboard end with a pair of free ends with a first orientation in engagement with each other and a second orientation separated from each other;

a decorative assembly including a threaded shaft extending upwardly from the post and a hemispherical decoration screwably coupled to the post; and a plurality of planar rectangular plates each formed from a rigid material, each plate having a periphery including a short top edge, a short bottom edge and a pair of elongated side edges, an inboard one of the side edges of each plate having three vertically aligned apertures formed therein for releasably coupling with the binder rings of one of the side faces of the post, the top edge of each plate having a plurality of rectangular cut outs formed therein and having varying widths for supporting necklaces, each plate further having a matrix of circular bores formed therein adjacent to the bottom edge thereof for receiving posts of pierce earrings and a matrix of diamond-shaped bores formed in each plate adjacent to the bottom edge thereof beneath the matrix of circular bores for receiving clips of clip earrings.

2. A jewelry holder comprising:

a base;

a post rotatably coupled to the base;

a plurality of planar plates each with an inboard edge coupled to the post for supporting jewelry thereon; and wherein the plates are removably mounted to the post via a plurality of binder rings each having a pair of free ends removably engaged with each other.

3. A jewelry holder as set forth in claim 2 wherein each plate has a horizontally oriented top edge.

4. A jewelry holder as set forth in claim 2 wherein the base is weighted.

5. A jewelry holder as set forth in claim 2 wherein a decorative assembly is mounted on the post.

6. A jewelry holder as set forth in claim 2 wherein each plate has a plurality of cut outs formed in a top edge thereof.

7. A jewelry holder as set forth in claim 2 wherein each plate has a matrix of circular bores formed therein for receiving posts of pierce earrings.

8. A jewelry holder as set forth in claim 2 wherein a matrix of diamond-shaped bores is formed in each plate for receiving clips of clip earrings.

9. A jewelry holder as set forth in claim 2 wherein the plates are hingably coupled to the post.

* * * * *